US006601360B2

(12) United States Patent
Spiers

(10) Patent No.: US 6,601,360 B2
(45) Date of Patent: Aug. 5, 2003

(54) MODULAR DECK TILES

(76) Inventor: Barry Spiers, 78 Ritva Court, Richmond Hill, Ontario (CA), L4K 9R4

( * ) Notice: Subject to any disclaimer, the term of this patent is extended or adjusted under 35 U.S.C. 154(b) by 0 days.

(21) Appl. No.: 09/811,477

(22) Filed: Mar. 20, 2001

(65) Prior Publication Data

US 2002/0134039 A1 Sep. 26, 2002

(51) Int. Cl.[7] ..... E04H 12/00

(52) U.S. Cl. ..... 52/650.3; 52/592.1; 52/667; 52/664; 52/663; 52/669

(58) Field of Search ..... 52/592.1, 667, 52/177, 650.3, 549, 581, 384, 664, 669, 663; 403/342; 156/293, 309.6, 303.1

(56) References Cited

U.S. PATENT DOCUMENTS

| | | | | | |
|---|---|---|---|---|---|
| 4,008,548 | A | * | 2/1977 | Leclerc | 428/131 |
| 4,555,886 | A | * | 12/1985 | Wiechowski | 156/309.6 |
| 4,608,798 | A | | 9/1986 | Spiers | |
| 4,749,302 | A | * | 6/1988 | DeClute | 404/37 |
| 4,958,425 | A | * | 9/1990 | Gomes | 29/433 |
| 5,226,273 | A | | 7/1993 | Burke | |
| 5,758,467 | A | | 6/1998 | Snear et al. | |
| 5,784,741 | A | * | 7/1998 | Mangone | 14/73 |
| 5,806,121 | A | * | 9/1998 | Mangone | 14/73 |
| 6,098,362 | A | | 8/2000 | Marriott et al. | |
| 6,128,880 | A | * | 10/2000 | Meenan, Jr. | 403/231 |
| 6,305,432 | B1 | * | 10/2001 | Sacks et al. | 139/425 R |

FOREIGN PATENT DOCUMENTS

| | | | | |
|---|---|---|---|---|
| CA | 1174026 | | 9/1984 | |
| EP | 0328639 | * | 7/1987 | E01C/5/14 |
| JP | 5-51962 | * | 3/1993 | E04B/1/16 |
| WO | WO 99/36638 | | 7/1999 | |

* cited by examiner

*Primary Examiner*—Carl D. Friedman
*Assistant Examiner*—Chi Q. Nguyen
(74) *Attorney, Agent, or Firm*—Marks & Clerk

(57) ABSTRACT

A modular deck tile comprises a plurality of slats which are joined together by at least two flexible tubes extending through the thickness of each of the slats. So as to preserve the spacing of the slats, and to keep them in place, the tubes may be laterally deformed in the region between each pair of slats so as to cause a greater cross wise dimension than the diameter of the passage through which the tubes extend. Alternatively, the slats may be joined one to another by poppet connectors.

14 Claims, 4 Drawing Sheets

MODULAR DECK TILES

FIELD OF THE INVENTION

The present invention relates to modular deck tiles which are formed with a plurality of slats. The modularity comes from the fact that the dimensions of the deck tiles—at least, the width of the deck tiles—may be buried by the simple expedient of choosing the number of slats which will be utilized. The deck tiles of the present invention are double-sided; that is, they may be turned over if they are damaged or weathered.

BACKGROUND OF THE INVENTION

Many people prefer the use of slatted deck tiles, or at least the appearance of a slatted decking, in many decorating circumstances. For example, many people prefer a slatted flooring or decking on a balcony, as opposed to a concrete floor, or a floor on which tile or carpet is laid. Same holds true for decks and porches of the sort that may be built at the front or rear of a house, at a certain level above the ground. A particular use for slatted deck tiles is in gardening, where a walkway or patio may be wished to be built, or decking around a pool—whether in-ground or above-ground.

There are many advantages to the use of slatted decks, not the least of which is that there is no tendency for water to collect on the deck. This may lead to a longer life, particularly when wood is used, as rotting is less likely. The use of slats also permits, in circumstances, the application of a vivid imagination whereby slats of varying colours may be placed either in a pattern or randomly.

In any event, many opportunities present themselves for the use of deck tiles, and especially in gardens, for patios, and for balcony flooring.

Of course, each circumstance where a deck tile may be used is probably different than the next circumstance, as to the dimensions of the overall area to be tiled, and perhaps even as to the smoothness or regularity of the surface on which the deck tiles are to be laid.

For example, a balcony floor would generally be quite smooth, as would the area where a patio is to be built. On the other hand, in a garden, or a walkway through a yard, the terrain may slope, and it may be somewhat uneven. Modular deck tiles in keeping with the present invention will accommodate at least a modicum of unevenness, due to the flexibility of the structural tubes which hold a plurality of slats together, or due to the flexibility of a poppet connector between adjacent slats, all as discussed hereafter.

Thus, there is a certain flexibility in at least one direction, whereas there is substantial rigidity in the other direction of each modular deck tile in keeping with the present invention. The flexibility is across the width, the rigidity is along the length of the deck tile. Moreover, the width of a modular deck tile in keeping with the present invention may be modified at will, as will be discussed in greater detail hereafter.

Typically, modular deck tiles of the present invention comprise a plurality of wooden slats. However, they may be manufactured with slats of other material than wood, and the precise choice of material is of no particular significance.

However, the typical choice of wood is advantageous for two reasons: first, the wood which is used may be scrap wood, because each individual slat is not very large, and there remains a large supply of scrap wood from the building industry, the freight industry, other industries where materials are shipped and stored on skids, the cooperage industry, and the like. The other particular reason is the aesthetic attraction and appeal of wood, which may have a natural colour, or which may be painted or stained through a very wide variety of colours and finishes.

A typical modular deck tile in keeping with the present invention will generally be square, but not necessarily. If square, typical deck tiles in keeping with the present invention will have dimensions of approximately 50 cm to 75 cm per side—usually, about 60 cm per side. However, each slat will have a length of 50 cm to 75 cm, and a modular tile may comprise as few as two slats and as many as ten to fifteen slats. Thus, a modular tile might be manufactured, or adjusted, so as to have dimensions of from 10 cm or 15 cm up to 50 cm to 75 cm wide, by 50 cm to 75 cm long.

DESCRIPTION OF THE PRIOR ART

A previous patent issued to the inventor herein is Spiers U.S. Pat. No. 4,608,798, issued Sep. 2, 1986, and its cognate Canadian Patent 1,174,026, issued Sep. 11, 1984. Each patent teaches a modular building component comprising a plurality of slats, an exposed bore and a cooperating plug for joining modular building components one to the other. There is no contemplation of the change of size of the modular building components; and in the only practical embodiment of those modular building components the elongated members are joined to the flexible tubes passing through them by being stapled thereto. This results in a stretcher which has only one side, because the stapled side cannot be placed upwardly for reasons of security and safety, and because over time the staples tend to rust and discolour the material of the elongated members.

Burke U.S. Pat. No. 5,226,273, issued Jul. 13, 1993 teaches an overlay brick deck system where a plurality of bricks or brick-like members are placed over a supporting slatted wooden deck.

Snear et al U.S. Pat. No. 5,758,467 issued Jun. 2, 1998 teaches an inter-connectable modular deck member which may be used in decking, flooring, roofing, and so on. Here, mateable connectors are formed integrally with construction members for connecting successive deck members to form a deck assembly. Each modular construction member includes a gutter portion and a groove portion, which may be joined together to form a substantially water-proof structure.

Marriott et al U.S. Pat. No. 6,098,362, issued Aug. 8, 2000 teaches a plastic tile and trough assembly which is also used to cover wooden decks, the plastic tiles are screwed onto the deck in a manner so that the screws are isolated from water. A series of troughs is provided so as to prevent water from reaching the wood of the deck beneath the plastic tiles.

Ezydeck Pty, Ltd. WIPO Publication WO99/36638, published Jul. 22, 1999, teaches a decking tile in which a plurality of slats is received in a side-by-side manner. A plurality of apertures is provided to receive connector means by which the slats are connected to the decking tile, and connectors are provided around the periphery of the decking tile for connecting it to other decking tiles. The tile is divided into a plurality of portions which are connected one to another by a plurality of membranes, and each portion is removable from the tile upon severing the membranes which surround it.

SUMMARY OF THE INVENTION

In a first embodiment, the present invention provides a modular deck tile which comprises a plurality of slats that includes a first slat and at least a second slat, and at least two flexible tubes.

The plurality of slats are arranged in parallel relationship, and each of the slats is spaced apart one from the other. Each slat has first and second side edges, and top and bottom edges.

The first and second side edges of the slats have at least two passages which are formed in parallel spaced apart relationship. Each of the at least two passages is equal distance from each of the top and bottom edges of each of the slats, and each of the at least two passages may receive one of the at least two flexible tubes. Thus, each of the at least two flexible tubes extends through a respective one of the at least two passages of each of the slats.

Each of the flexible tubes is laterally deformed in the region between each pair of slats, so that the crosswise dimension of each of the flexible tubes is greater than the diameter of each of the passages formed in each of the pair of slats. Thus, the slats are each secured in place as a consequence of the lateral deformation of the flexible tubes.

Also, each of the flexible tubes has first and second ends, and each of the flexible tubes has stop means at each of its first and second ends.

Typically, each of the slats of the modular deck tile of the present invention is of rectangular cross-section.

Each of the flexible tubes is laterally deformed along its length by crimping the tube at pre-determined points.

In a particular variation, the flexible tubes are crimped at at least one position in the region between each pair of slats.

In another variation, each of the flexible tubes is crimped at two positions in the region between each pair of slats.

The stop means which is provided at each of the first and second ends of each of the flexible tubes extends beyond the first side edge of the first slat and the second side edge of the terminal slat at the other side of the deck tile, respectively.

Indeed, in another variation of the present invention, each of the first and second ends of each of the flexible tubes may be longitudinally deformed so as to provide a stop means at each of the first and second ends of the flexible tubes.

Other manners in which the stop means may be provided is by swaging each of the first and second ends of each of the flexible tubes, or by flanging each of the first and second ends of each of the flexible tubes.

Typically, but not necessarily, each of the first and second ends of each of the flexible tubes has stop means chosen from the group of stop means consisting of self-threading flat-head bolts, self-threading countersink bolts, and tapered plugs.

Also, of course, each of the first and second ends of the flexible tube may otherwise be laterally deformed so as to provide a stop means at each of the first and second ends of the flexible tubes.

In that case, the stop means situated at the first and second ends of each of the flexible tubes is formed by crimping each of the first and second ends of each of the flexible tubes.

In a second general embodiment of the present invention, there is provided a modular deck tile which comprises a plurality of slats including at least a first slat and at least a second slat. The slats are arranged in parallel relationship, and each of the slats is spaced apart one from the other.

Each of the slats has first and second side edges, and first and second ends.

Each of the first and second side edges has at least two apertures which are formed in opposed parallel spaced apart relationship. Each of the at least two apertures are equal distance from each of the first and second ends, and each of the at least two apertures in opposed first and second edges of adjacent slats has coupling means received therein.

Those coupling means comprise cooperative male and female connecting members that are received in the apertures in opposed first and second side edges of adjacent slats.

The male connecting member in one of the at least two apertures of the first slat is adapted to engage the female connecting member in a respective opposed one of the at least two apertures of the second slat which is adjacent to the first slat.

Accordingly, the connecting portion of each of the cooperative male and female members of the coupling means is disposed between each pair of slats.

Typically, each of the slats is of rectangular cross-section.

Each of the coupling means may comprise a poppet connector.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

The novel features which are believed to be characteristic of the present invention, as to its structure, organization, use and method of operation, together with further objectives and advantages thereof, will be better understood from the following discussion.

Figure 1:
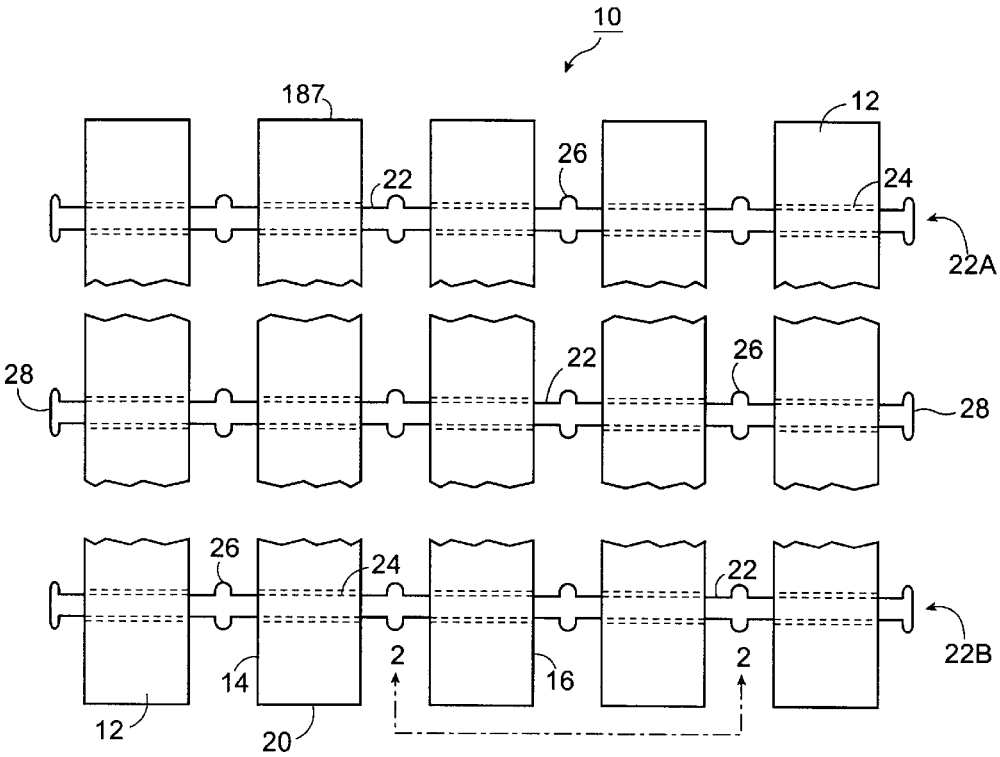
FIG. 1 is a plan view of portions of a first embodiment of modular deck, in keeping with the present invention.
Figure 3:
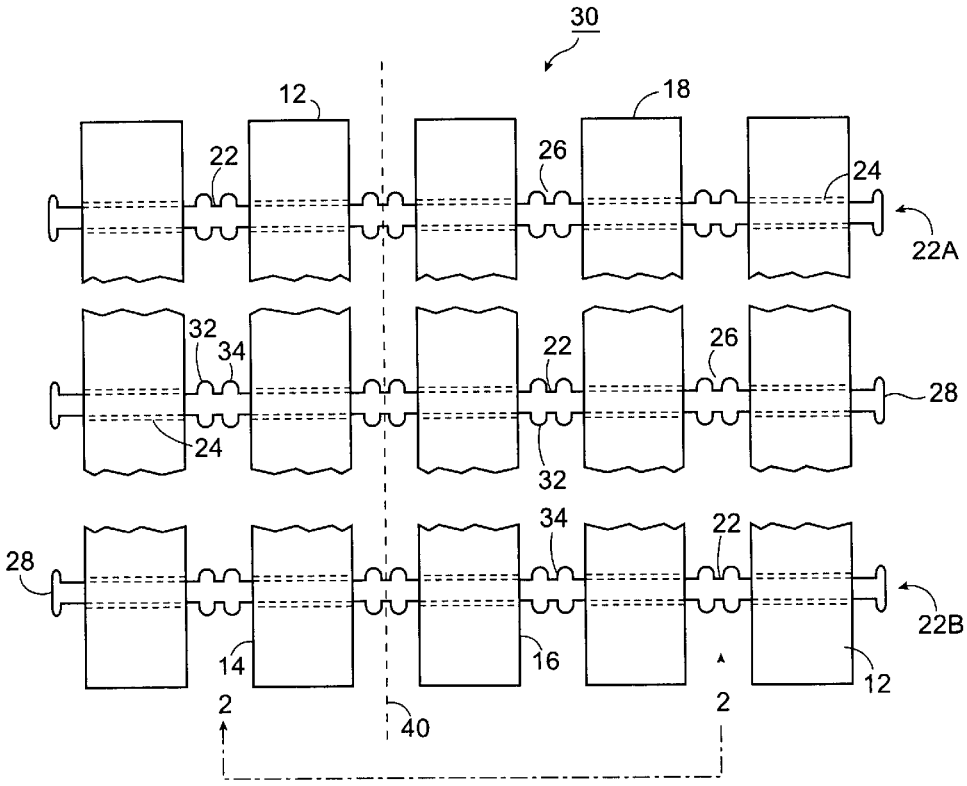
FIG. 3 is a view similar to FIG. 1, showing another variation of the first embodiment of the present invention.
Figure 9:
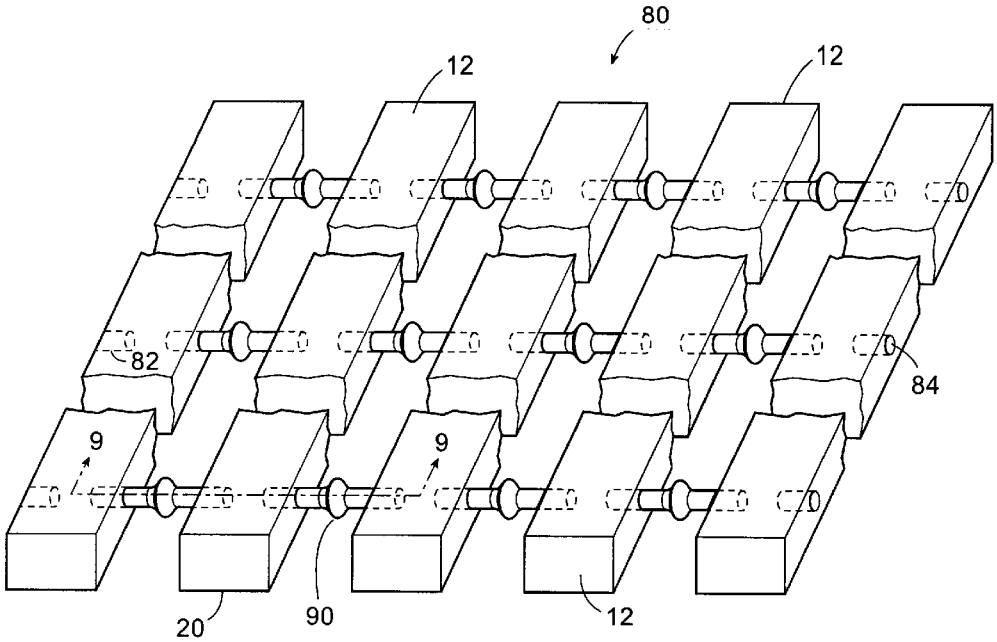
FIG. 9 is a partially perspective view of portions of a second embodiment of modular deck tile in keeping with the present invention.

Typical embodiments of modular deck tiles in keeping with the present invention are shown at 10, 30, and 80, in FIGS. 1, 3, and 9, respectively. Each modular deck tile comprises a plurality of slats 12, each of which is substantially rectangular in cross-section having first and second side edges 14 and 16.

Each slat has a first end and a second end 18 and 20, respectively.

In the embodiments of FIGS. 1 through 8, at least two flexible tubes 22 are employed. Typically, for purposes of stability, three tubes are employed.

In any event, having regard to FIGS. 1 and 3, at least two tubes 22*a* and 22*b* are employed, and each of those tubes 22*a* and 22*b* is the same distance from the respective ends 18 and 20 of any of the slats 12. Thus, any slat 12 can be turned over, in the manner described hereafter; and in any event, there is no right and left ends or top and bottom ends to be worried about during assembly of modular deck tiles in keeping with the present invention.

If a third flexible tube 22 is employed, it will typically pass through the centre of each of the slats 12, for the same reason as described above.

Of course, each of the slats 12 is arranged in parallel relationship with respect one to another, and each of the slats 12 is spaced apart one from the other.

The flexible tubes 22 pass through passages 24 which are formed in parallel spaced apart relationship, equidistantly from the ends 18 and 20 as discussed above. The size of each of the passages 24 is just sufficient to receive a flexible tube 22. Typically, the outer diameter of the flexible tubes 22 is in the range of 1 cm to 1.5 cm, and the diameter of the passages 24 is 1 mm or 2 mm greater.

Figure 2:
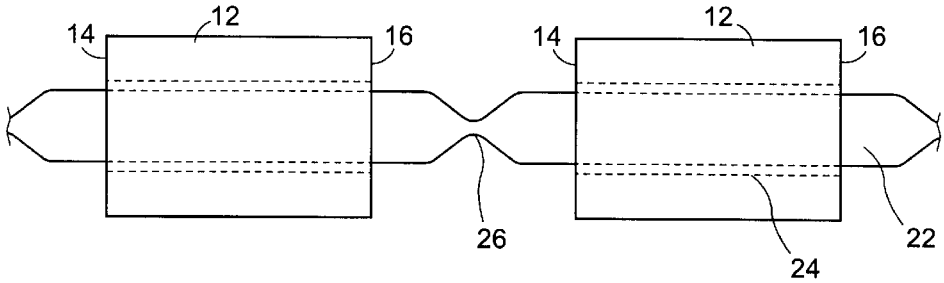
FIG. 2 is an elevation taken in the direction of arrows 2—2 in FIG. 1.

In the embodiment shown in FIGS. 1 and 2, each of the flexible tubes 22 is laterally deformed in the region between each pair of slats 12, as shown at 26. Obviously, the crosswise dimension of the flexible tubes in the region where they have been laterally deformed is greater than the diameter of each of the passages 24. This is evident from an examination of FIG. 1, for example.

By placing the lateral deformations 26 in the flexible tubes 22, each of the slats 12 is secured in place. That is, the slats may slide slightly one toward another, but only to a limited extent; and in any event, the structural integrity of the modular deck tile 10 is assured when, for example, the tile is picked up using one of the slats 12.

However, to ensure that the end slats remain in place, stop means shown generally at 28 in FIG. 1 are employed. Specific stop means are described in greater detail hereafter.

Figure 4:
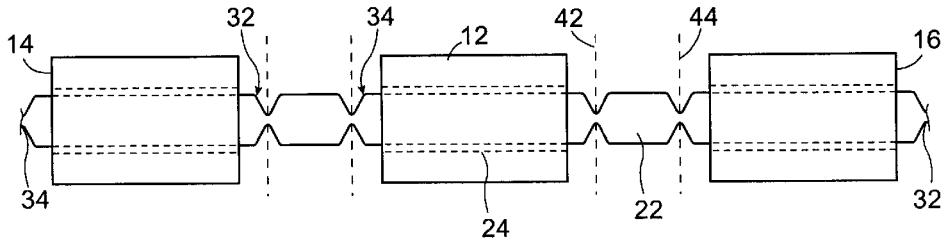
FIG. 4 is a view similar to FIG. 2, along arrows 4—4 of FIG. 3.

Turning to FIGS. 3 and 4, an alternative embodiment 30 of a modular deck tile employs the use of a plurality of slats 12 and at least two flexible tubes 22, is shown. This embodiment provides at least two advantages over the embodiments of FIGS. 1 and 2. The first is that there is less slippage or movement of the slats 12 along the flexible tube 22, and thus they maintain their relative positions much more effectively. The other advantage is that, as will be described hereafter, the flexible tubes 22 may be caught in several different positions to achieve several different purposes, including the provision of an alternative stop means at the outer edges of a modular deck tile.

As seen in each of FIGS. 3 and 4, the flexible tubes 22 are crimped in two positions 32 and 34. Once again, the lateral deformation is such that the crosswise dimension the flexible tubes 22 at each of the lateral deformation places 32 and 34 is greater than the diameter of the passages 24.

It can be appreciated from each of FIGS. 1 and 3 that the width of a modular deck tile may be adjusted simply by cutting the flexible tubes 22 at one of a variety of elective locations—where each elective location is chosen at the same place between the same pair of slats 12, in each instance.

That arrangement makes the modular deck tiles of the present invention truly modular, in that their width can be varied from two slats up to many slats.

For example, a cut could be made through locations 26 in the embodiment of FIGS. 1 and 2, so as to remove several slats away from the preassembled modular deck tile 10, where the deck tiles are being put into place in the field and the width of the area where the deck tiles are to be placed is less than a simple multiple of the width of each respective modular deck tile 10.

More flexibility exists with respect to the embodiments of FIGS. 3 and 4. Here, cuts may be made along line 40, for example, or along either or both of lines 42 and 44.

Especially when cuts are made along lines 42 and 44, it will be seen that appropriate stop means are also provided by the lateral deformation of the flexible tubes 22, at the respective edges 14 or 16 of any slat 12, or pair of slats 12.

Other stop means are also contemplated, as illustrated in FIGS. 5, 6, 7 and 8, whereby the outer slats of a modular deck tile are precluded from being removed away from the modular deck tile.

Of course, it will be appreciated that, for the most part, the modular deck tiles of the present invention have a constant dimension, and for the most part are square or of a specific rectangular conformation. However, due to fitting in the field, or for purposes of repair, it may sometimes be necessary to change the width of the modular deck tile.

However, in any event each modular deck tile in keeping with the present invention—that is, in keeping with the embodiments of FIGS. 1 through 4, requires a stop means on the outer most first and second side edges 14 and 16, respectively, of the outer most slats 12.

Figure 5:
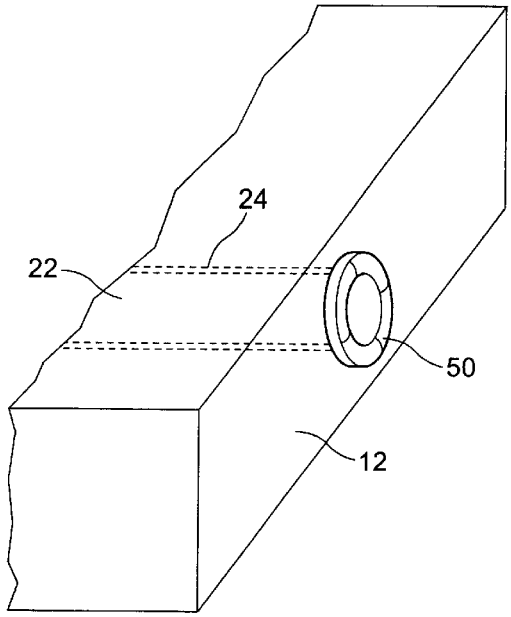
FIG. 5 is a perspective view of a typical stop means employed by the present invention.
Figure 6:
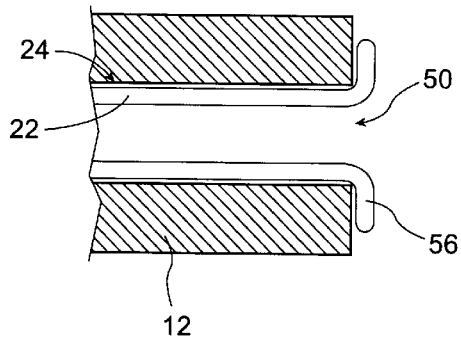
FIG. 6 is a cross-section of the embodiment of FIG. 5.

A typical stop means is illustrated in FIG. 5. Here, the flexible tube 22 has been longitudinally deformed so as to provide a stop means 50 which precludes the slat 12 from sliding off the flexible tube 22, or which precludes the flexible tube 22 from being withdrawn away from the slat 12. The stop means 50 thereby comprises a flange 56, as seen in FIG. 6. The flange 56 has a greater diameter than the diameter of the passageway 24.

Typically, the process by which the stop means 50 may be formed includes swagging the ends of the flexible tube 22, or flanging them using a flanging tool.

Figure 7:
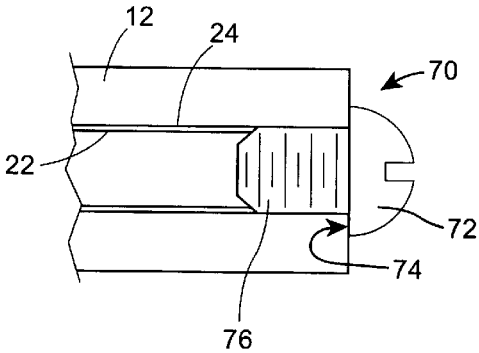
FIG. 7 is a cross-section of another embodiment of stop means in keeping with the present invention.

Another stop means is shown in FIG. 7, at 70, and comprises a self-threading flat-head bolt 72 which is threaded into the end of the flexible tube 22. Obviously, the diameter of the flat undersurface 74 of the head of the self-threading flat-head bolt 72 is greater than the diameter of the passageway 24. The diameter of the shank 76 of the self-threading flat-head bolt 72 is substantially the same or just slightly less than the diameter of the passageway 24, so that the material of the flexible tube 22 will be captured and extruded between the threads of the self-threading flat-head bolt, and the material of the flexible tube 22 will be squeezed against the interior surface of the passageway 24. A very secure stop means is thereby achieved; but it will be appreciated that the stop means is such that it can be undone so as to replace an outside flat, if necessary.

Figure 8:
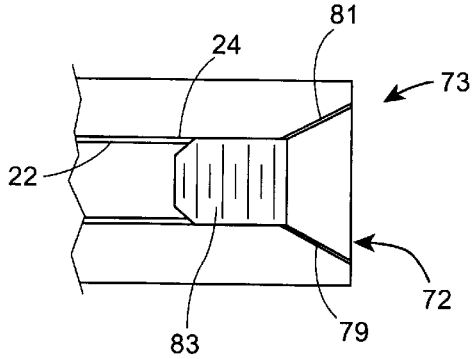
FIG. 8 is a cross-section of a further embodiment of stop means in keeping with the present invention.

More typically, when deck tiles are placed adjacent one to the other, stop means 73 may be employed, as can be seen particularly in FIG. 8. Here, a self-threading countersink bolt 77 is threaded into the end of the flexible tube 22, wherein the countersunk head 79 of the self-threading countersink bolt 77 is fitted snuggly in the countersunk hole 81. Similar to the self-threading flat-head bolt 72 shown in FIG. 7, the diameter of the shank 83 of the self-threading countersink bolt 77 is substantially the same or just slightly less than the diameter of the passageway 24, so that the material of the flexible tube 22 will be captured and extruded between the threads of the self-threading countersink bolt 77, and the material of the flexible tube 22 will be squeezed against the interior surface of the passageway 24 such that a secured stop means is achieved. In an alternative variation, a tapered plug having a countersunk head may be used which is driven into the countersunk hole 81.

It has already been noted that stop means can also be provided by crimping the flexible tube 22, such as at 26, 32, or 34, and cutting the tube through the crimp such as at lines 42 and 44.

Figure 10:
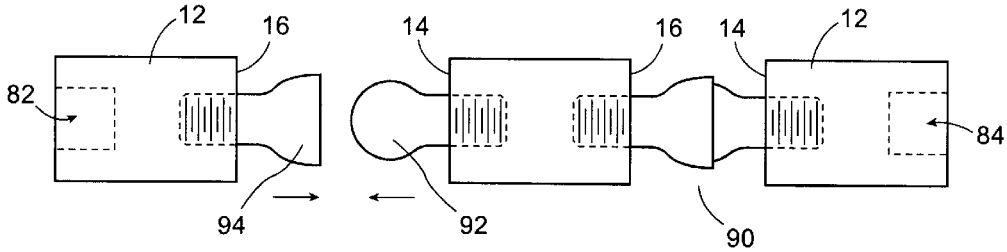
FIG. 10 is a cross-section taken in the direction of arrows 9—9 in FIG. 9.
Figure 11:
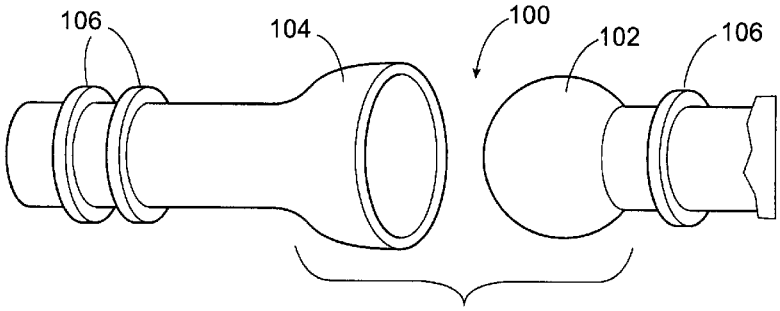
FIG. 11 shows a typical poppet connector which may be employed in keeping with the present invention.

Another embodiment of modular deck tile in keeping with the present invention is shown in FIGS. 9 through 11. In this embodiment, which also comprises a plurality of slats 12, each of which has first and second side edges 14 and 16 respectively, there are no passageways which are formed through the width of the slats 12.

Rather, each of the slats 12 has a pair of apertures 82 and 84 formed in the respective side edges 14 and 16, respectively. Each of the apertures 82 and 84, which are formed in pairs, are formed in opposed parallel spaced apart relationship as can be clearly seen by examination of FIGS. 9 and 10.

Moreover, as previously, the apertures 82 and 84, or at least two apertures 82 and 84 in each slat 12, are formed at equal distances from the first and second ends 18 and 20 of the respective slats 12. Once again, the purpose is so that any slat may be employed in any orientation, without regard to top or bottom ends, without regard to top or bottom surfaces, and without regard to left or right sides.

There are provided between adjacent slats 12 coupling means shown at 90 in FIGS. 9 and 10. Those coupling means may typically be a poppet connector, as shown at 100 in FIG. 11, but other ball and socket or pin and hole coupling means may also be appropriately used.

In any event, the coupling means comprises cooperative male and female connecting members 92 and 94, respectively; or cooperating poppet connecting male and female members 102 and 104. Obviously, the male connecting member 92 or 102 is adapted to connect or engage the female connecting member 94 or 104. In the embodiment shown, each of the male members 92 is placed in the apertures 82 formed in the side edges 14 of each of the slats 12; and each of the female connecting members 94 is placed in the apertures 84 that are formed in the side edges 16 of the slats 12.

When connected, the connecting portion of the cooperative male and female members of the coupling means 90 is disposed between each adjacent pair of slats 12, and seen in FIGS. 9 and 10.

The male and female connecting members 92 and 94 may be threaded into the respective apertures 82 and 84, as suggested in FIG. 10.

Also, they may be formed with collars 106 as shown in FIG. 11, permitting them to be forced and squeeze fitted into the respective apertures 82 and 84.

Obviously, there is no necessity for the provision of stop means 28, or specific stop means as shown in FIGS. 5 through 8, for the embodiment of modular deck tile shown in FIGS. 9 and 10. Instead, the respective apertures 82 and 84 may simply be left unfilled, they may be plugged for purposes of appearance; and in some instances, it is possible that special slats may be prepared with apertures on only one side so that, in the proper orientation, those apertures will be either apertures 82 or 84. Such arrangement is achieved simply by turning that specific slat 12 over.

Typically, modular deck tiles 80 are assembled in the factory, just as modular deck tiles 10 and 30 are assembled in the factory, because jigging and assembly tools are available for those purposes. However, the modular deck tiles 80 may also be assembled in the field, if necessary; and it is evident that they may be disassembled in the field, or at least one or several slats may be removed from a modular deck tile 80, without the necessity of employing special purpose tools, cutters, crimping devices, and the like.

There has been described a modular deck tile, and several embodiments of the modular deck tile have been specifically disclosed. However, other modifications and amendments to the configuration of modular deck tiles in keeping with the present invention may be made without departing from the spirit and scope of the appended claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially planar is intended to mean planar, nearly planar and/or exhibiting characteristics associated with a planar element.

What is claimed is:

1. A modular deck tile comprising:

a plurality of slats including at least a first slat and at least a second slat, and at least two flexible tubes;

wherein said plurality of slats are arranged in parallel relationship, and each of said slats is spaced apart one from the other;

wherein each of said slats has first and second side edges, and first and second ends;

wherein said first and second side edges have at least two passages which are formed in parallel spaced apart relationship;

wherein each of said at least two passages is equidistant from each of said first and second ends of each of said slats, and each of said at least two passages may receive one of said at least two flexible tubes;

wherein each of said at least two flexible tubes extends through a respective one of said passages of each of said slats;

wherein each of said flexible tubes is laterally deformed in the region between each pair of slats such that the crosswise dimension of each of said flexible tubes is greater than the diameter of each of said passages formed in each of said pair of slats, so as to secure each of said slats in place; and wherein each of said flexible tubes has first and second ends, and each of said flexible tubes has stop means at each of said first and second ends.

2. The modular deck tile of claim 1, wherein each of said slats is of rectangular cross section.

3. The modular deck tile of claim 1, wherein each of said flexible tubes is laterally deformed along its length by crimping at predetermined points.

4. The modular deck tile of claim 3, wherein each of said flexible tubes is crimped at at least one position in the region between each of said pair of slats.

5. The modular deck tile of claim 3, wherein each of said flexible tubes is crimped at two positions in the region between each of said pair of slats.

6. The modular deck tile of claim 1, wherein said stop means at each of said first ends of each of said flexible tubes extends beyond said first side edge of said first slat, and wherein said stop means at each of said second ends of each of said flexible tubes extends beyond said second side edge of the terminal slat.

7. The modular deck tile of claim 1, wherein each of said first and second ends of each of said flexible tubes is longitudinally deformed so as to provide a stop means at each of said first and second ends of each of said flexible tubes.

8. The modular deck tile of claim 7, wherein said stop means situated at each of said first and second ends of each of said flexible tubes is chosen from the group of stop means consisting of:

(a) swaging each of said first and second ends of each of said flexible tubes; and (b) flanging each of said first and second ends of each of said flexible tubes.

9. The modular deck tile of claim 1, wherein each of said first and second ends of each of said flexible tubes has stop means chosen from the group of stop means consisting of self-threading flat-head bolts, self-threading countersink bolts, and tapered plugs.

10. The modular deck tile of claim 1, wherein each of said first and second ends of each of said flexible tubes is laterally deformed so as to provide a stop means at each of said first and second ends of each of said flexible tubes.

11. The modular deck tile of claim 10, wherein said stop means situated at each of said first and second ends of each of said flexible tubes is formed by crimping each of said first and second ends of each of said flexible tubes.

12. A modular deck tile comprising:

a plurality of slats including at least a first slat and at least a second slat;

wherein said plurality of slats are arranged in parallel relationship, and each of said slats is spaced apart one from the other;

wherein each of said slats has first and second side edges, and first and second ends;

wherein each of said first and second side edges has at least two apertures which are formed in opposed parallel spaced apart relationship;

wherein each of said at least two apertures are equidistant from each of said first and second ends, and each of said at least two apertures in opposed first and second side edges of adjacent slats has coupling means received therein;

wherein said coupling means comprises cooperative male and female connecting members received in said apertures in said opposed first and second side edges;

wherein said male connecting member in one of said at least two apertures of said first slat is adapted to engage said female connecting member in a respective opposed one of said at least two apertures of said second slat which is adjacent to said first slat; and wherein the connecting portion of each of said cooperative male and female members of said coupling means is disposed between each pair of slats.

13. The modular deck tile of claim 12, wherein each of said slats is of rectangular cross section.

14. The modular deck tile of claim 12, wherein each of said coupling means comprises a poppet connector.

* * * * *